United States Patent [19]

Frye et al.

[11] Patent Number: 4,514,134

[45] Date of Patent: Apr. 30, 1985

[54] DOUBLE SIDEWINDER

[75] Inventors: Samuel M. Frye, Joanna; James O. Singleton, Spartanburg, both of S.C.

[73] Assignee: Milliken Research Corporation, Spartanburg, S.C.

[21] Appl. No.: 467,769

[22] Filed: Feb. 18, 1983

[51] Int. Cl.[3] ..... B66F 9/14

[52] U.S. Cl. ..... 414/659; 414/785

[58] Field of Search ..... 414/278, 277, 281, 282, 414/659, 662, 663, 495

[56] References Cited

U.S. PATENT DOCUMENTS

| | | | |
|---|---|---|---|
| 2,828,040 | 3/1958 | Fitton et al. | 414/662 |
| 3,292,804 | 12/1966 | Veneman | 414/659 |

FOREIGN PATENT DOCUMENTS

| | | | |
|---|---|---|---|
| 39266 | 3/1977 | Japan | 414/663 |
| 47278 | 4/1977 | Japan | 414/281 |
| 47277 | 4/1977 | Japan | 414/277 |
| 111973 | 9/1978 | Japan | 414/281 |

*Primary Examiner*—Robert J. Spar
*Assistant Examiner*—Stuart J. Millman
*Attorney, Agent, or Firm*—Earle R. Marden; H. William Petry

[57] ABSTRACT

A load handling vehicle of the sidewinder type which can handle loads located on either side of the load handling vehicle without manual help. In particular, the load handling vehicle has at least two load handling conveyors which can be used to handle two loads on one trip of the load handling vehicle.

1 Claim, 4 Drawing Figures

DOUBLE SIDEWINDER

This invention relates generally to load handling vehicles and in particular to load handling vehicles which can automatically handle loads located at either side of the direction of movement of the load handling vehicle without manual help in locating the load on the vehicle.

Therefore it is an object of the invention to provide a side loading load handling vehicle which can efficiently and easily handle at least two loads of material without unloading one load of material prior to picking up a second load.

Other objects and advantages of the invention will become readily apparent as the specification proceeds to describe the invention, with reference to the accompanying drawings, in which.

Figure 1:
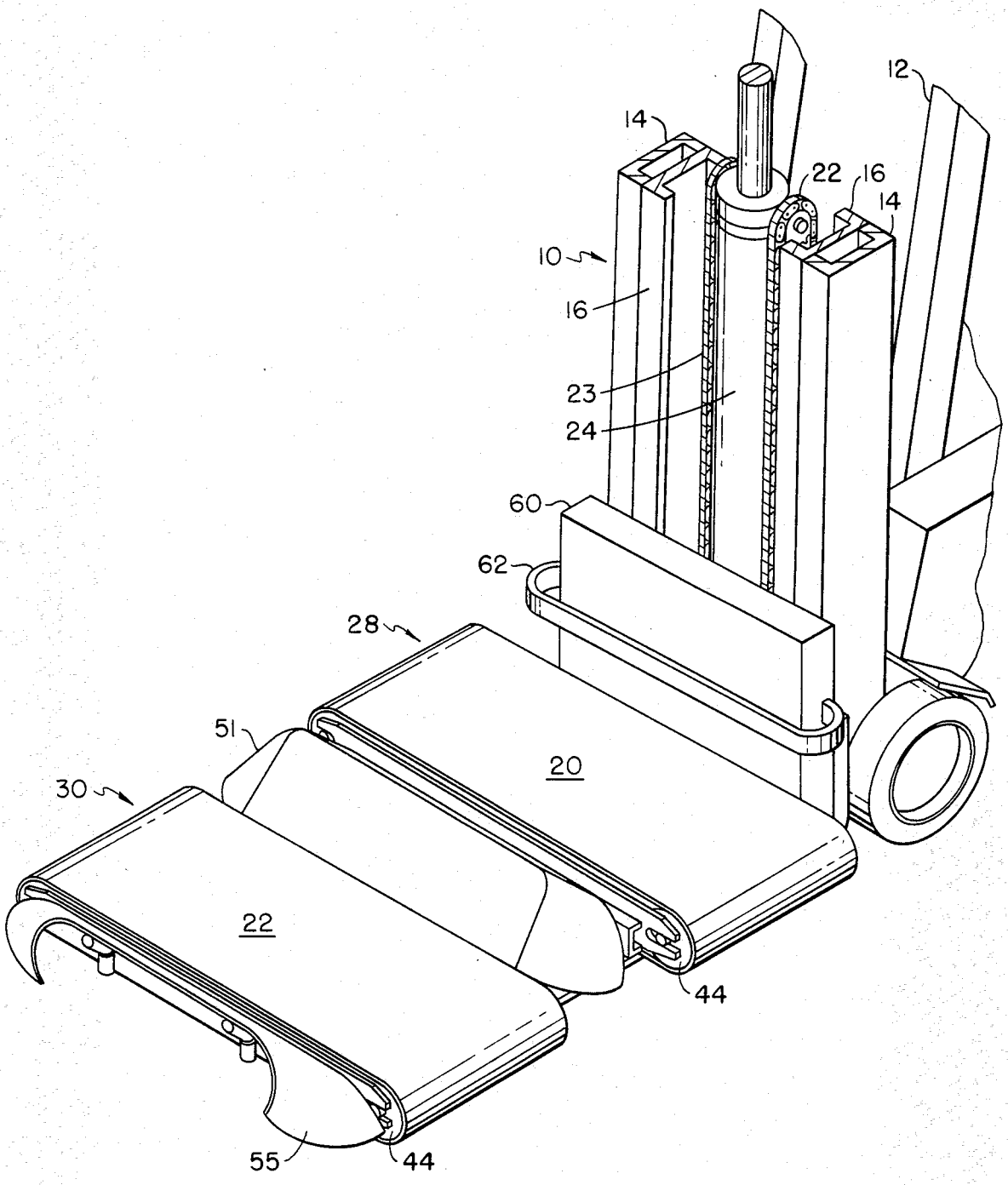
FIG. 1 is a perspective view of the new and novel double load handling vehicle.
Figure 2:
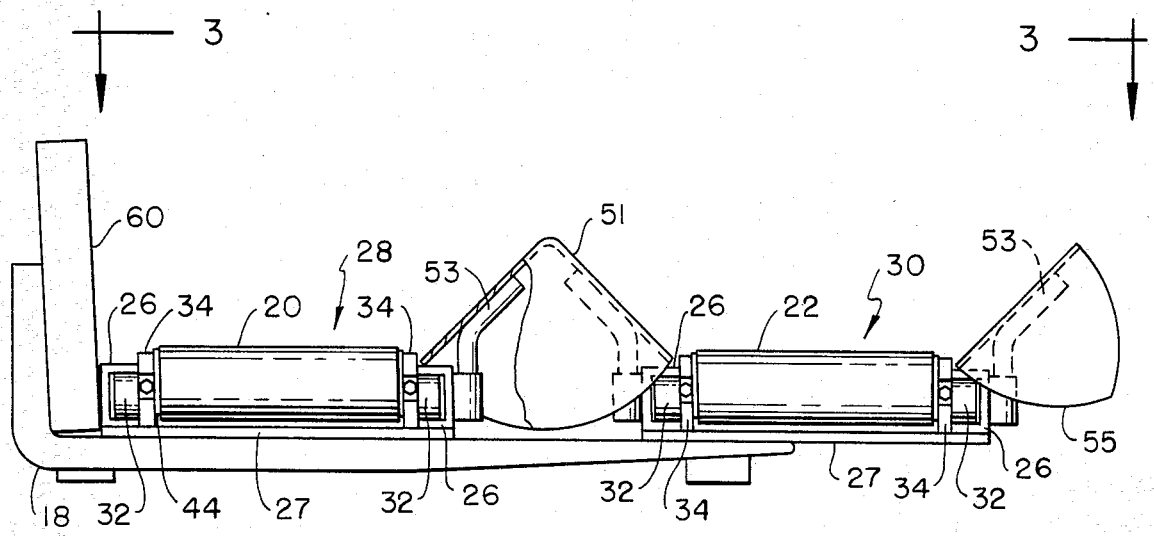
FIG. 2 is the left side view of the load handling mechanism of the load handling vehicle of FIG. 1.
Figure 3:
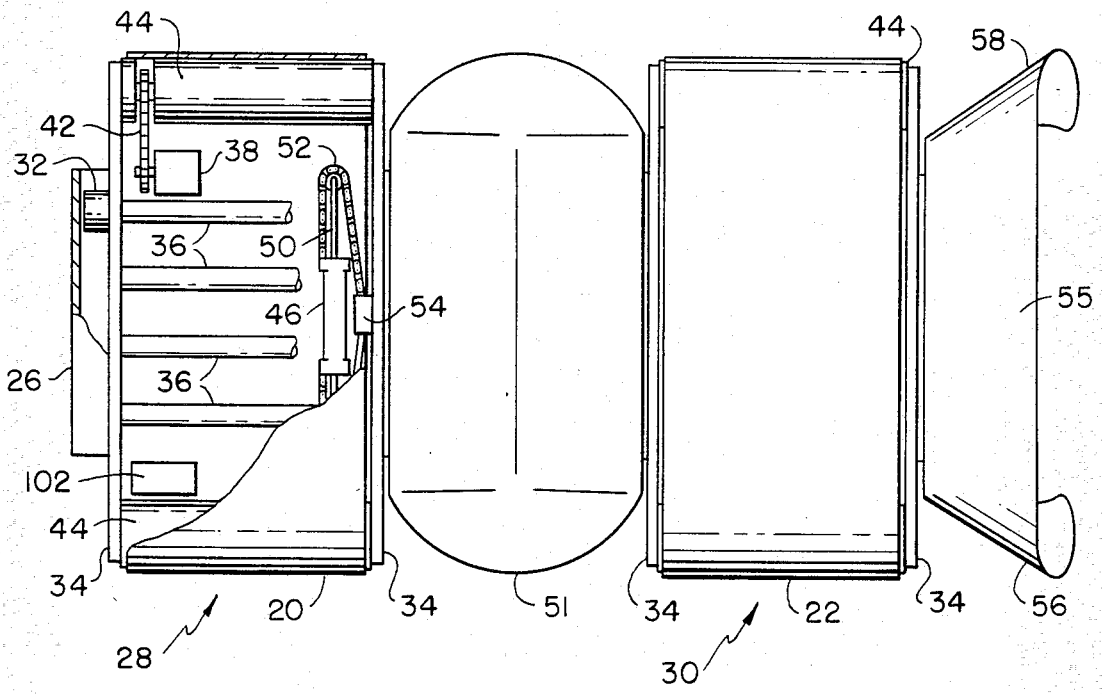
FIG. 3 is a view taken on line 3—3 of FIG. 2.

Referring now to the drawings and especially FIG. 1, the reference numeral 10 represents generally the vertical mast structure of a lift truck mounted for limited tilting movement of the forward post of the lift truck 12. As shown in FIG. 1, mast structure 10 is of a well known construction including a lower support member, not shown, from which channel-shaped support members 14 extend upwardly in parallel spaced relationship to one another. Mounted with respect to the channels 14 are the channel members 16 which guide the upward and downward movement of the lift elements 18 on which are mounted the conveyors 20 and 22. In conventional manner the lift elements are raised and lowered by the chain 23 driven by the hydraulic lift motor 24.

The load handling conveyors 20 and 22 are mounted on the lift elements 18 through the use of channel members 26 mounted on support plates 27 connected in suitable manner to the lift elements. Each of the conveying units 28 and 30 for conveyors 20 and 22, respectively, are supported and guided in channel members 26 by rollers 32 connected to side plates 34 slidably mounted on support plates 27. Each pair of side plates 34 for each conveying unit 28 or 30 are held in spaced relationship by a support plate (not shown) connected therebetween with the confines of the particular conveyor 20 or 22.

The conveyors 20 and 22 are guided in their path of travel by a plurality of rollers 36 connected between the side plates 34 of the conveyors 20 and 22 and are driven, respectively by reversible hydraulic motors 38 and 40 which, through sprocket chain 42, drives the rollers 44 of the conveying systems 28 and 30. To move each of the conveying systems 28 and 30 to the right or to the left, hydraulic actuated pistons 46 and 48 through piston rods 50 act against the chain 52 to move the carrying system in one direction or the other since the chain coupling 54 is connected to a pin (not shown) fixed to one of the channel members 26.

Fixed to facing channel members 26 is a triangular guide plate 51 mounted and secured by angle iron members 53. On the front of the load handling vehicle is another guide plate 55 secured by another angle iron member 51 secured to the respective channel iron section 26. The front edge 56 and the back 58 of the guide members 55 are rolled back to guide the load onto and off of the conveyor 22. Mounted on the upright portion of the left elements is a metallic box 60 to protect the control devices for the conveyors. Mounted to the box 60 is a load guide bar 62 to prevent the load of the conveyor 20 from damaging the box 60 and the devices contained therein.

Figure 4:
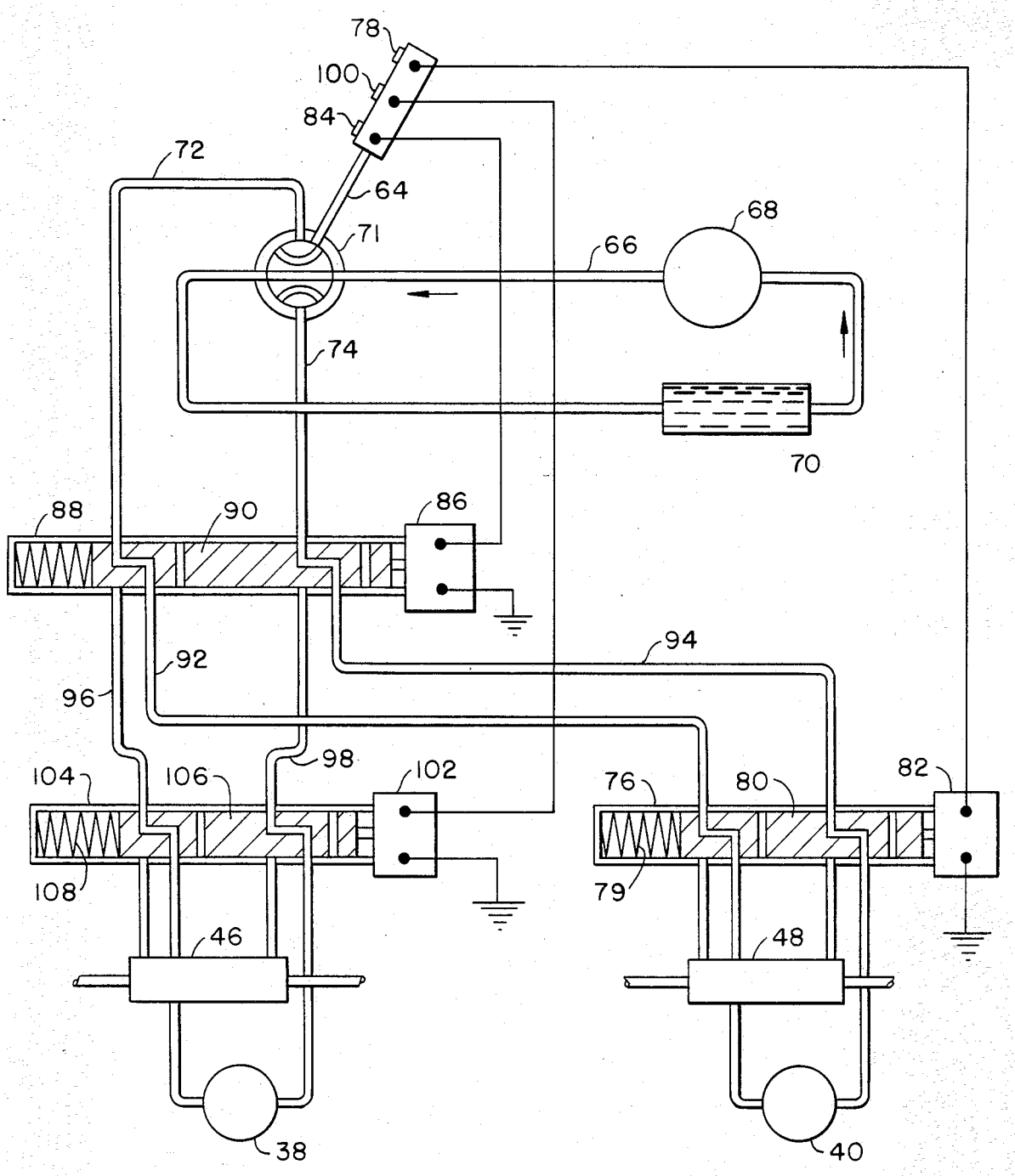
FIG. 4 is a schematic representation of the hydraulic control system for movement of the load handling mechanism.

The operation and position of the conveyors is controlled by the circuit shown schematically in FIG. 4. The control system is basically hydraulic, actuated by a plurality of solenoid controlled valves. As shown, with the operating handle 64 in the neutral position hydraulic fluid is maintained in the closed loop 66 which includes the pump 68 and the reservoir 70. When the handle is moved to the right or to the left, the four-way valve 71 will be rotated to either connect the output of the pump to the conduit 72 or the conduit 74. As can readily be seen the reversal of the four-way valve 71 will reverse the flow of hydraulic fluid and thusly reverse the action of the pistons 46 and 48 and/or the action of reversible motors 38 and 40 depending on which solenoids are actuated.

As shown and if the handle 64 is moved in the direction to place the pump output in communication with the conduit 72, hydraulic fluid is being supplied through the solenoid actuated valve 76 to the motor 40 to cause the conveyor 22 to rotate in one direction. Then, if it is desired to move the conveyor system 30 in one direction or the other, the button 78 is depressed to cause the valve body 80 of the valve 76 to be moved to the left by the solenoid coil 82 to supply fluid to the piston 48. Then the button 78 is released and the valve body is moved back to the right by spring 79 and fluid is again supplied to conveyor 22 and is rotated again. To reverse the action of the pump 40 or the valve 76, the handle 64 is moved to the opposite direction to reverse the flow of hydraulic fluid in conduits 72 and 74.

If it is desired to actuate the conveying system 28, the handle 64 will be moved right or left and the button 84 depressed to actuate the coil 86 of the valve 88 which will cause the valve body 90 to move to the left cutting off communication between conduits 72, 74 with conduits 92, 94. This will provide fluid flow in conduits 96, 98 to the reversible motor 38 to cause the conveyor 20 to rotate in one direction or the other depending on the position of the handle 64. If it is desired to move the conveying system 28 to the right or the left, the button 100 will also be depressed to actuate the coil 102 of the valve 104 to cause the valve body 106 to move to the left to provide fluid to the piston 46 and move the conveying system in the desired direction. Once the conveying system has been moved, the button 100 is released and the spring 108 moves the valve body 106 back to the right thus re-establishing fluid communication to the reversible, hydraulic motor 38. As can be seen the particular direction of movement of the pistons 46, 48 and the action of the reversible motors 38 and 40 is controlled by the position of the handle 64 which rotates the valve 71 to control the flow of hydraulic fluid from the pump 68 to or from the conduits 72 and 74.

The herein disclosed load handling vehicle can efficiently handle at least two loads of material on a single trip of the vehicle which obviously allows an operator to handle more loads in a given amount of time. This provides faster transfer of goods from storage to a desired location, allows the number of vehicles used for load handling to be reduced and increases the efficiency of operation.

Although we have described the preferred embodiment of the invention, it is contemplated that changes may be made without departing from the scope or spirit of our invention and we desire to be limited only by the claims.

We claim:

1. A load handling vehicle of the lift truck type having a substantially vertical mast and a vertically moveable lift fork extending horizontally from said vertical mast and being connected thereto, the improvement comprising: a pair of conveying systems mounted on said lift fork, each of said conveying systems having a conveyor belt, said conveyor belts being spaced from one another and being moveable in either direction independent of the movement of the other, deflection means mounted between said conveyor belts to guide a load onto one or the other of said conveyor belts and a control means operated with said conveying system to control the independent movement of each of the conveyor belts and the independent rotation of each of said belts.

* * * * *